US006119621A

United States Patent [19]

Johnson

[11] Patent Number: 6,119,621

[45] Date of Patent: Sep. 19, 2000

[54] BARRIER AND/OR MODULAR CONE

[75] Inventor: Mike Johnson, Bentonville, Ark.

[73] Assignee: Barbara Johnson, Bentonville, Ark.

[21] Appl. No.: 09/291,291

[22] Filed: Apr. 14, 1999

[51] Int. Cl.[7] ..... E01F 9/012; E01F 9/019

[52] U.S. Cl. ..... 116/63 C; 116/63 R; 40/612; 256/1

[58] Field of Search ..... 116/63 C, 63 R, 116/63 P; 404/9, 10; 40/603, 605, 606, 610, 612; 256/1, 13.1

[56] References Cited

U.S. PATENT DOCUMENTS

| | | | |
|---|---|---|---|
| 2,090,783 | 8/1937 | Chinn | 40/610 |
| 2,887,983 | 5/1959 | Budd . | |
| 3,021,755 | 2/1962 | Karchenes | 248/472 |
| 3,200,786 | 8/1965 | Swezy et al. . | |
| 3,291,096 | 12/1966 | Walter . | |
| 3,380,290 | 4/1968 | Moinicken et al. | 116/63 R |
| 3,777,428 | 12/1973 | Caufield . | |
| 4,055,840 | 10/1977 | Uchytil et al. . | |
| 4,209,928 | 7/1980 | Kraayvanger . | |
| 4,256,050 | 3/1981 | Barnard . | |
| 4,462,145 | 7/1984 | Schulze . | |
| 4,817,318 | 4/1989 | Strauch . | |
| 4,844,420 | 7/1989 | Oster | 256/1 |
| 4,848,263 | 7/1989 | Grimm . | |
| 5,198,799 | 3/1993 | Pascale | 340/552 |
| 5,199,375 | 4/1993 | Johnson . | |
| 5,269,251 | 12/1993 | Freeman | 116/63 C |
| 5,467,548 | 11/1995 | Ross | 40/612 |
| 5,500,642 | 3/1996 | Battle | 340/932.2 |
| 5,755,174 | 5/1998 | Freeman | 116/63 C |

FOREIGN PATENT DOCUMENTS

| | | |
|---|---|---|
| 1188988 | 3/1965 | Germany . |
| 1395169 | 5/1975 | United Kingdom . |

*Primary Examiner*—Andrew H. Hirshfield
*Assistant Examiner*—R. Alexander Smith
*Attorney, Agent, or Firm*—Aquilino, Welsh & Flaxman

[57] ABSTRACT

The present invention relates to a modular cone. The modular cone includes a tubular member and a selectively collapsible base member coupled to the tubular member, wherein the base member may be selectively collapsed and stored within the tubular member. In addition, different embodiments of the modular cone include reflective surfaces, a self-storing barrier tape, and various caps such as a strobe.

14 Claims, 6 Drawing Sheets

FIG. 4
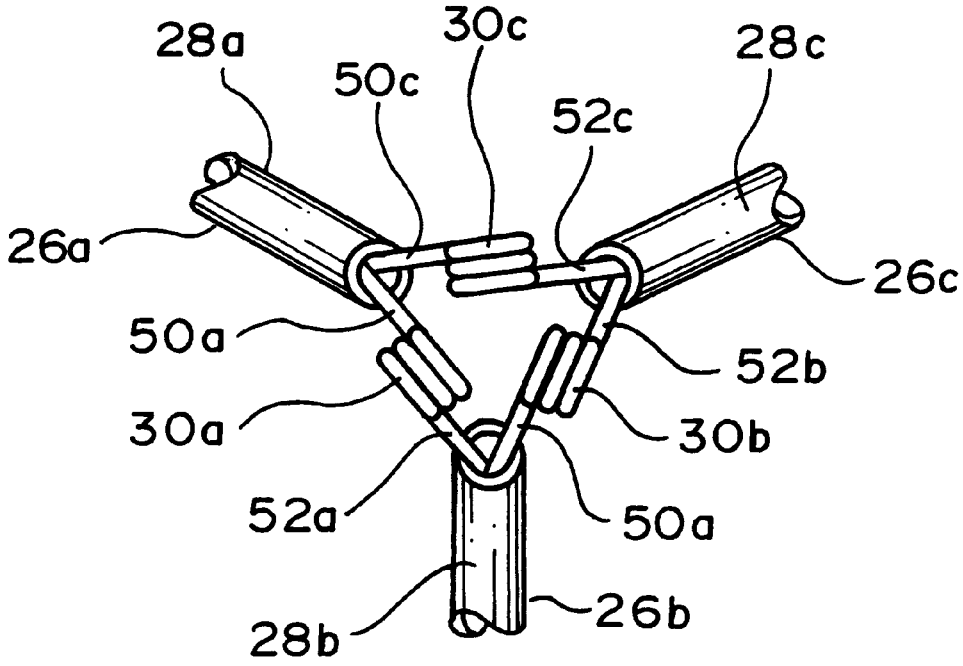
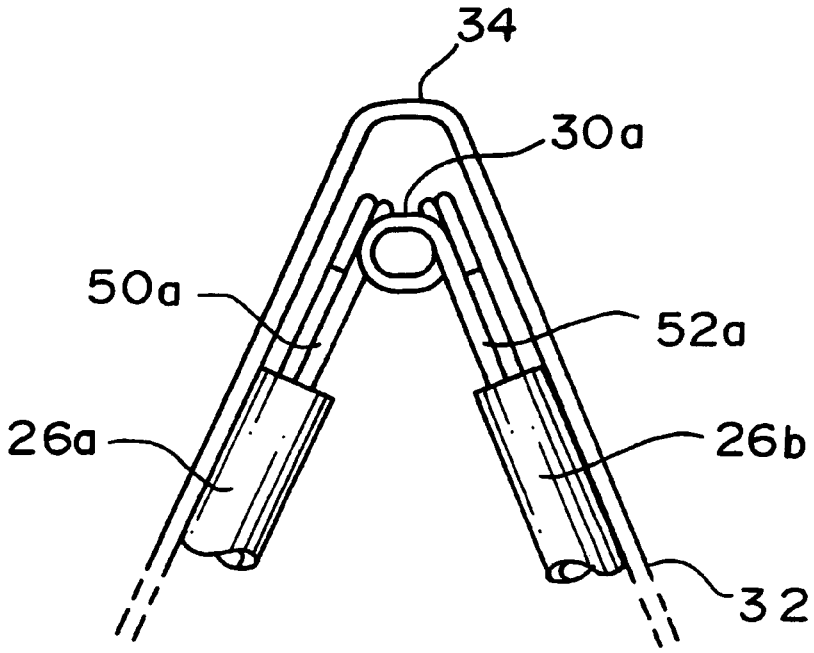
FIG. 5

BARRIER AND/OR MODULAR CONE

BACKGROUND OF THE INVENTION

1. Field of the Invention

The invention relates to a barrier and/or warning marker. More particularly, the invention relates to a compact, readily available warning marker which may be used alone or in combination with a plurality of markers to form an effective barrier.

2. Description of the Prior Art

Emergency situations and dangerous environments often require the creation of a barrier to warn individuals of potential danger. These barriers are commonly created by stands, pylons, or bracket structures which are transported to the dangerous location and positioned to create a barrier about the potential danger.

The barriers should be inexpensive and portable. In addition, the barriers should be highly visible to readily warn people of the impending danger. Unfortunately, nothing in the prior art provides a barrier which fully meets the needs of those responsible for assembling barriers. The present invention provides an inexpensive, portable and highly visible barrier and/or warning marker.

SUMMARY OF THE INVENTION

It is, therefore, an object of the present invention to provide a modular cone including a tubular member and a selectively collapsible base member coupled to the tubular member, wherein the base member may be selectively collapsed and stored within the tubular member.

It is also an object of the present invention to provide a modular cone including a barrier tape.

It is another object of the present invention to provide a modular cone including a strobe light.

It is a further object of the present invention to provide a modular cone including a sound port.

It is also an object of the present invention to provide a modular cone including a transmitter.

It is another object of the present invention to provide a modular cone wherein the base includes three stays.

It is a further object of the present invention to provide a modular cone wherein the three stays are resiliently biased to form a pyramid shaped base.

It is also an object of the present invention to provide a modular cone wherein the three stays are covered with a fabric cover.

It is another object of the present invention to provide a modular cone wherein a retaining ring couples the base member to the tubular member.

It is a further object of the present invention to provide a modular cone wherein the base member includes a reflective member.

It is also an object of the present invention to provide a portable barrier composed of a plurality of modular cones. Each modular cone includes a tubular member, a selectively collapsible base member coupled to the tubular member, wherein the base member may be selectively collapsed and stored within the tubular member, and a barrier member associated with each tubular member for selectively coupling the plurality of modular cones to create an effective barrier.

It is another object of the present invention to provide a portable barrier wherein the barrier member is barrier tape stored within the tubular member.

It is a further object of the present invention to provide a portable barrier wherein the barrier tape includes a free end including means for attachment to an adjacent modular cone.

It is also an object of the present invention to provide a portable barrier wherein the means for attachment is a hook member.

It is another object of the present invention to provide a portable barrier wherein the modular cone includes a recess for receiving the hook member.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a top view of the spring arrangement.

FIG. 5 is a side view of the spring arrangement.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
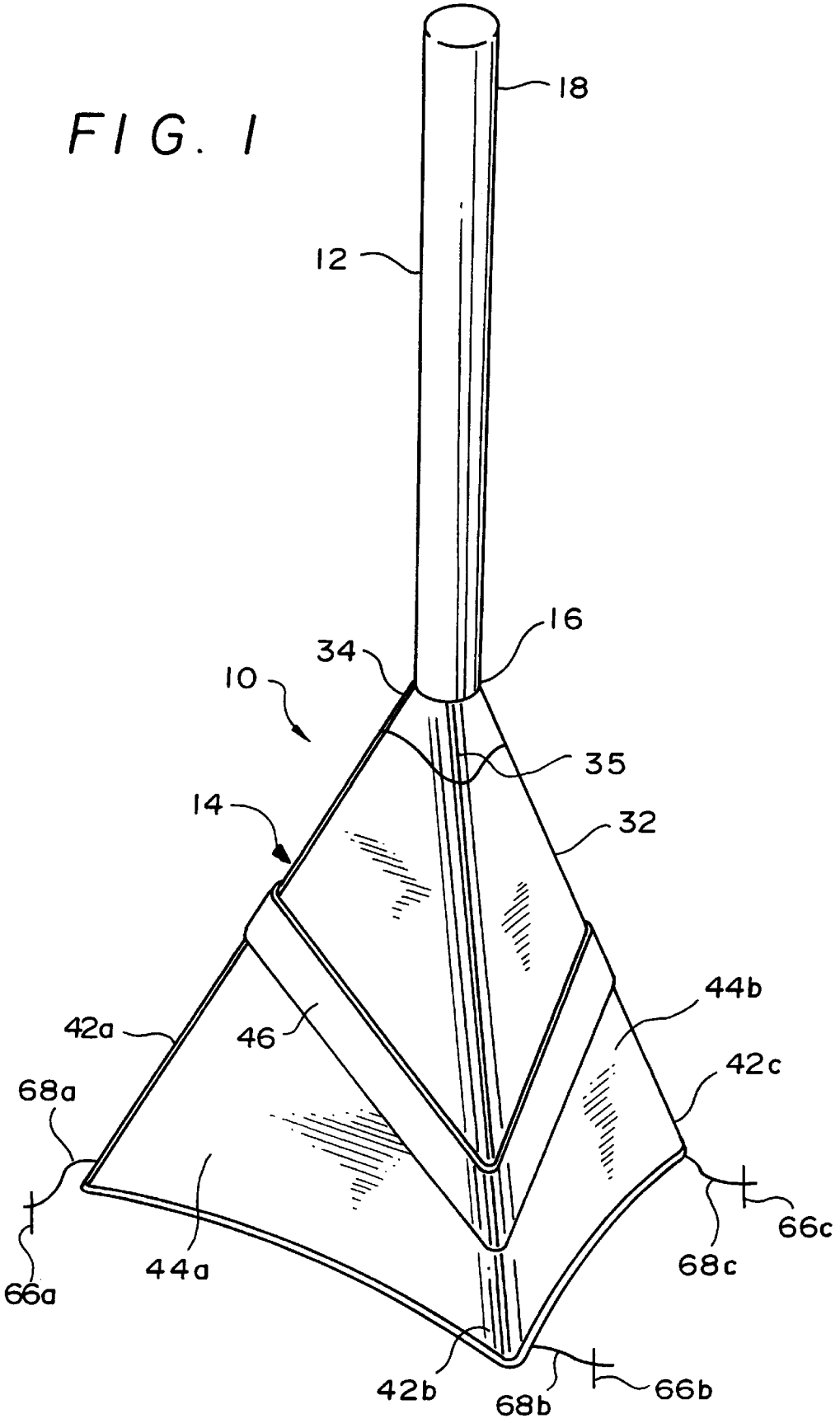
FIG. 1 is a perspective view of the modular cone in accordance with the present invention.

With reference to FIG. 1, a modular cone 10 in accordance with present invention is disclosed. As will be discussed in greater detail below, the modular cone 10 may be used alone as a warning marker or the modular cone may be used in combination with a plurality of modular cones to create an effective barrier (see FIG. 10). The modular cone 10 is very versatile and may be used by hunters, military personnel, backpackers, emergency personnel etc.

The modular cone 10 includes a tubular member 12 and a base 14. The tubular member 12 is a simple tube including an open first end 16 and a closed second end 18. The tubular member 12 may be formed from a variety of inexpensive, durable materials, for example, molded plastic.

The base 14 is a collapsible structure which may be readily stored within the tubular member 12 and retrieved therefrom when the modular cone 10 is needed. The base 14 is substantially similar to the structure disclosed in the inventor's own U.S. Pat. No. 5,199,375, entitled "Folding Warning Marker", which is incorporated herein by reference.

Specifically, when the base 14 is removed from the tubular member 12 it expands to form a very stable three-sided pyramid shaped base with the tubular member 12 extending therefrom. Once the need for the modular cone 10 is over, the base 14 may be collapsed and telescopically slid within the space defined by the interior of the tubular member 12.

Figure 2:
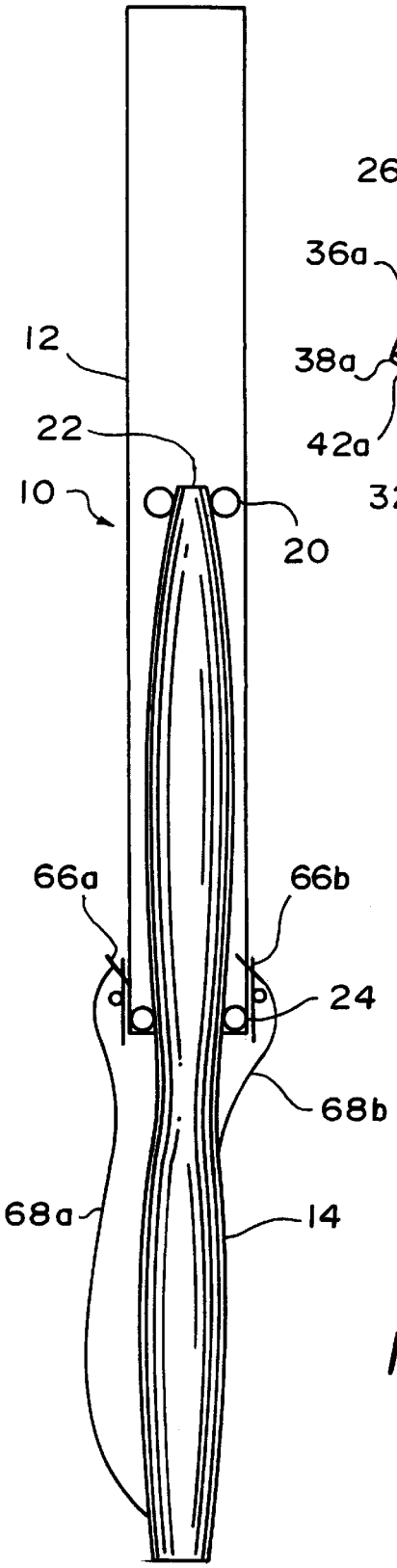
FIG. 2 is a partial cross sectional view showing the base within the tubular member.

With reference to FIG. 2, the base 14 is coupled to the tubular member 12 via a cylindrical sliding ring 20 attached at the top 22 of the base 14. The sliding ring 20 is of a diameter slightly smaller than the tubular member 12. In use, the sliding ring 20 slides up and down within the tubular member 12, and is retained within the tubular member 12 by a retainer ring 24 secured to the interior of the tubular member 12 adjacent the open second end 18 of the tubular member 12. The retainer ring 24 is only slightly larger than the sliding ring 20 and thereby retains the sliding ring 20 within the tubular 12, while allowing the sliding ring 20 to move within the body of the tubular member 12. Referring to FIGS. 1, 3, 4 and 5, the base 14 includes three tubular stays 26*a–c* having upper ends 28*a–c* joined together by torsional coil springs 30*a–c*. A flexible, brightly colored fabric cover 32 is received over the stays 26*a–c*. The fabric cover 32 may be reflective so as to provided added visibility to the modular cone 10. The torsional coil springs 30*a–c* bias adjacent pairs of the three stays apart, forming isosceles triangles. The triangles define the base 14 which assumes a pyramid shape. An apex region 34 of the fabric cover 32 is reinforced to withstand the stress induced by the torsional coil springs 30*a–c*. The lower end 36*a–c* of each tubular stay 26*a–c* is received in respective pockets 38*a–c* formed on an interior surface of the cover 32 adjacent the lower peripheral edge 40 of the fabric cover 32.

When one desires to collapse the base 14, the stays 26*a–c* are manually forced into a parallel relationship (see FIG. 2), forming a compact closed orientation of the base 14 for storage and transportation purposes. The collapsed base 14 is then inserted within the space defined by the interior of the tubular member 12.

Figure 3:
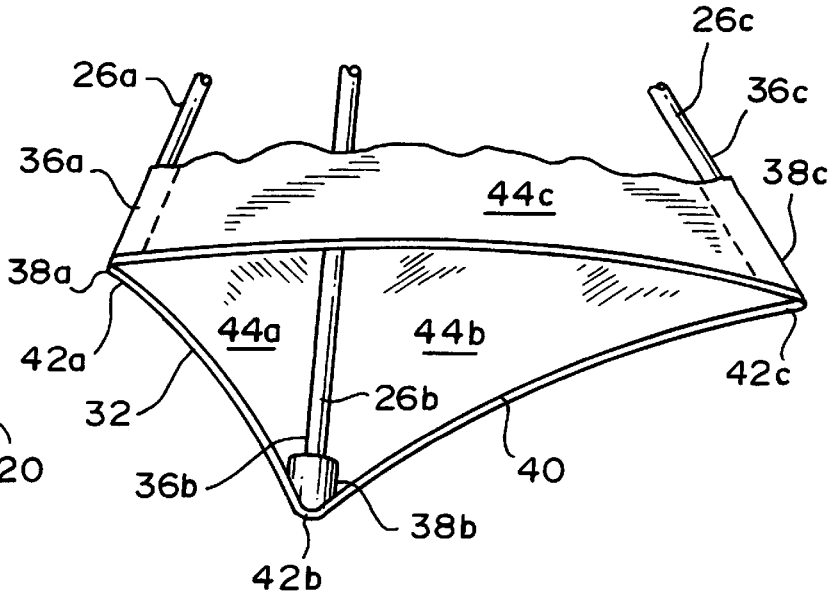
FIG. 3 is a detailed perspective view of the bottom of the base.

More specifically, the base 14 includes three corners 42*a–c* and an upper apex 34. The pyramidal open configuration of the folding base 14 is shown in FIGS. 1 and 3, and is defined by a flexible fabric cover 32 having three triangular faces 44*a–c*. The upper apex 34 of the fabric cover 32 is reinforced, for example, by utilizing a double fabric layer 35. A portion of the flexible cover 32 may be reflective, as for example, a reflective stripe or tape 46 may extend around the perimeter of the modular cone 10. The pyramidal configuration of the base 14 is maintained by the plurality of tubular support stays 26*a–c*. The support stays 26*a–c* each have an upper end 28*a–c* and a lower end 36*a–c*. The lower end 36*a–c* of each support stay 26*a–c* is received in a corresponding pocket 38*a–c* formed within the interior of the flexible fabric cover 32. Thus, each of the support stays 26*a–c* extends from a respective lower peripheral edge portion 40 to the upper apex 34.

As discussed above, a plurality of torsional coil springs 30*a–c* secure the upper ends 28*a–c* of the stays 26*a–c* together in the region of the apex 34 (See FIGS. 4 and 5). Each torsional coil spring has first and second free ends 50*a–c*, 52*a–c* received in respective support stays. For example, spring 30*a* has first and second free ends 50*a*, 52*a* respectively coupled to support stays 26*a* and 26*b*. Spring 30*b* has respective first and second free ends 50*b*, 52*b* coupled to stays 26*b*, 26*c*. Similarly, torsional coil spring 30*c* has free ends 50*c*, 52*c* coupled to respective tubular stays 26*a*, 26*c*. In summary, each of the torsional coil springs 30*a–c* has first and second free ends 50*a–c*, 52*a–c* inserted within a pair of adjacent support stays. This neutral securement is effective to bias the support stays 26*a–c* outwardly away from the remaining pair of stays.

The extent of outward movement of the support stays is limited by the pockets 38*a–c* retaining the stays 26*a–c* within the cover 32 such that the base 14 is movable between closed and open positions. While pockets 38*a–c* are used in accordance with the preferred embodiment of the present invention, other retaining structures may be employed without departing from the spirit of the present invention. The torsional coil springs 3O*a–c*, in conjunction with the shape of the cover 32, result in the formation of a three-sided pyramidal base 14 with the lower ends 36*a–c* of the support stays 26*a–c* resting upon a supporting surface in an open configuration in the manner of a tripod.

It is contemplated that the flexible cover of the base may be formed from a bright warning color and from a durable fabric material such as nylon. The support stays are preferably made from aluminum tubes, but may also be formed from nonmetallic materials such as fiberglass. It should also be understood that the torsional coil springs may be embedded or inserted into holes drilled into the ends of the stays or otherwise connected to the stays if non tubular stays are employed.

Figure 7:
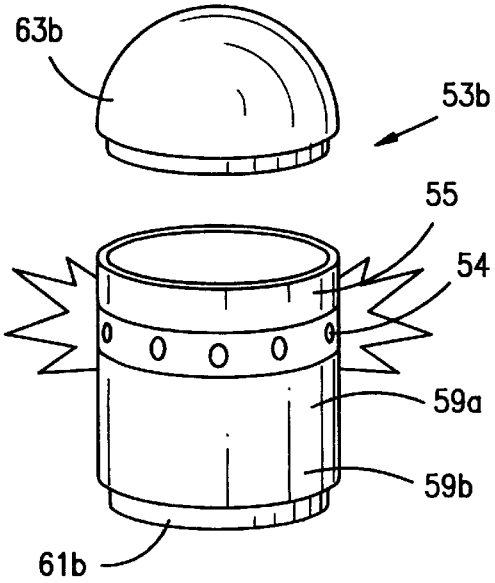
Figure 8:
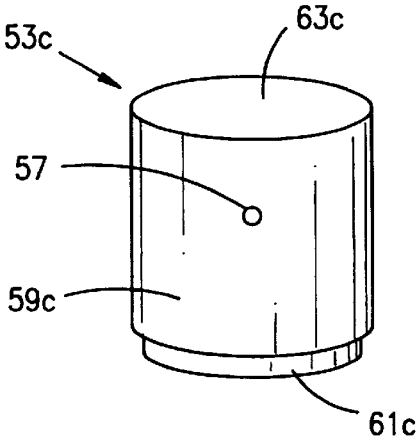
Figure 9:
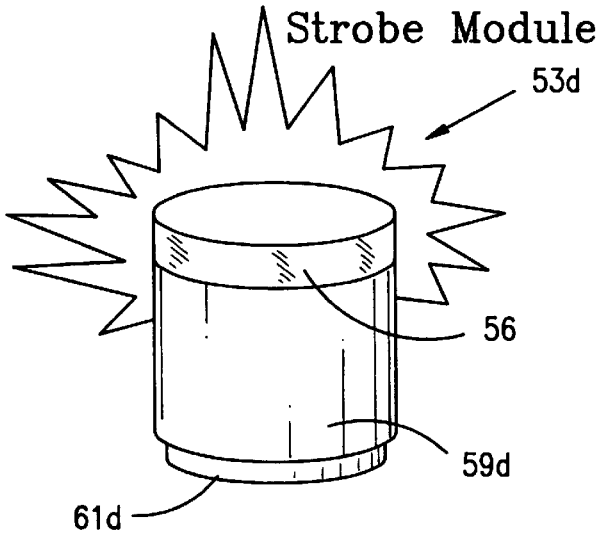

As discussed above, the tubular member 12 includes an open first end 16 and a closed second end 18. The first end 16 is shaped and dimensioned to telescopically receive the base member 14 when a user wishes to store the modular cone 10. The second end 18 of the tubular member 12 may be selectively provided with caps 53*a*, 53*b*, 53*c*, 53*d* respectively having a self contained barrier tape 58 (see FIGS. 6, 10 and 11), lights 54 and sound ports 55 (see FIG. 7), a transmitter 57 (FIG. 8) and strobe lights 56 (see FIG. 9). With reference to FIGS. 7, 8 and 9, the lights 54, sound ports 55, transmitter 57 and strobe lights 56 are respectively provided with on/off switches 59*a*, 59*b*, 59*c* and 59*d*.

Specifically, the caps are releasably secured (by screwing thereon) at the second end 18 of the tubular member 12 in such a manner that they can be readily replaced. In addition, and with reference to the embodiments shown in FIGS. 6, 7 and 8, the cap 53*a*, 53*b*, 53*c* is composed of a body member 61*a*, 61*b*, 61*c* and a cap member 63*a*, 63*b*, 63*c*. The cap member 63*a*, 63*b*, 63*c* is releasably screwed onto the body member 61*a*, 61*b*, 61*c* to allow access to the internal structure of the cap. With regard to the strobe embodiment disclosed in FIG. 9, the cap 53*d* is composed of a single piece 61*d* releasably secured to the tubular member 12. As those skilled in the art will readily appreciate, other embodiments may include audible emitters, emergency radio locators, GPS, and other appropriate add ons.

Figure 6:
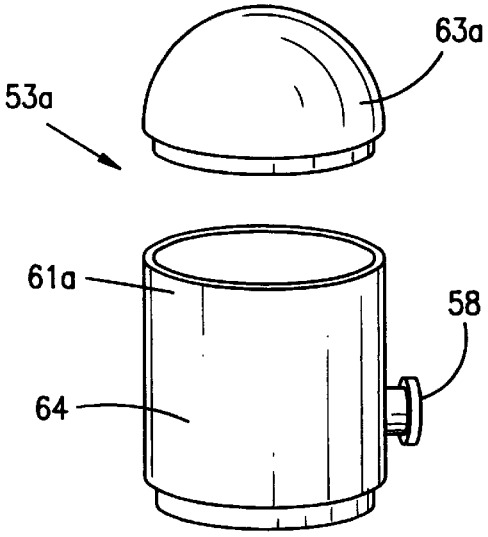
FIGS. 6, 7, 8 and 9 are plan views of various caps which may be used in accordance with present invention.
Figure 10:
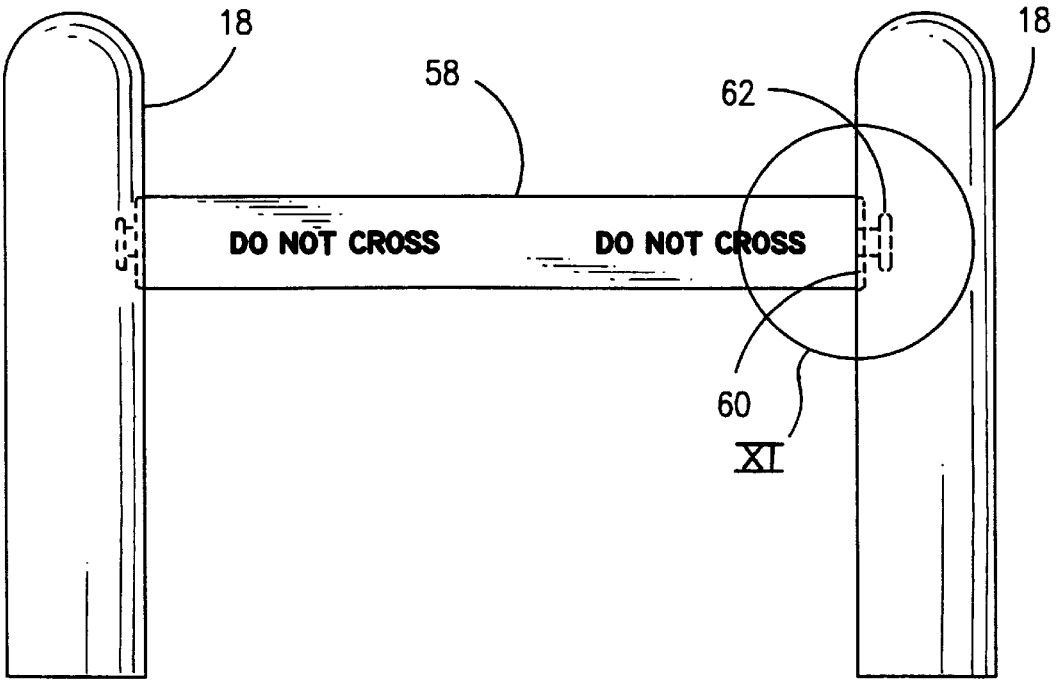
FIG. 10 is a plan view of the barrier tape embodiment in use.
Figure 11:
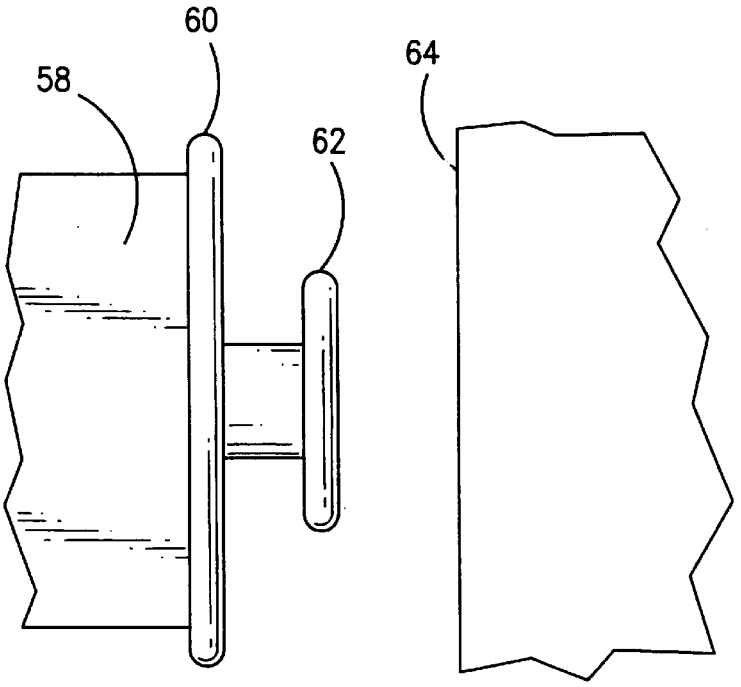
FIG. 11 is a detailed view of the section XI shown in FIG. 10.

With reference to FIGS. 6, 10 and 11, the self contained barrier tape 58 is a conventional resiliently biased barrier tape which may be drawn from the second end 18 of the tubular member 12 to create an effective barrier. As those of ordinary skill in the art will readily appreciate, the free end 60 of the barrier tape 58 is withdrawn from the second end 18 of the tubular member 12 and coupled to an adjacent modular cone 10 to create a barrier. For example, U.S. Pat. No. 4,844,420, to Oster, entitled "Retractable Crowd Control Barrier", discloses a resiliently biased barrier tape which may be used in accordance with the present invention. The '420 patent is incorporated herein by reference.

With this in mind, the free end 60 of the tape 58 includes a small hook 62 adapted for attachment within a recess 64 formed in the second end 18 of the tubular member 12.

Figure 12:
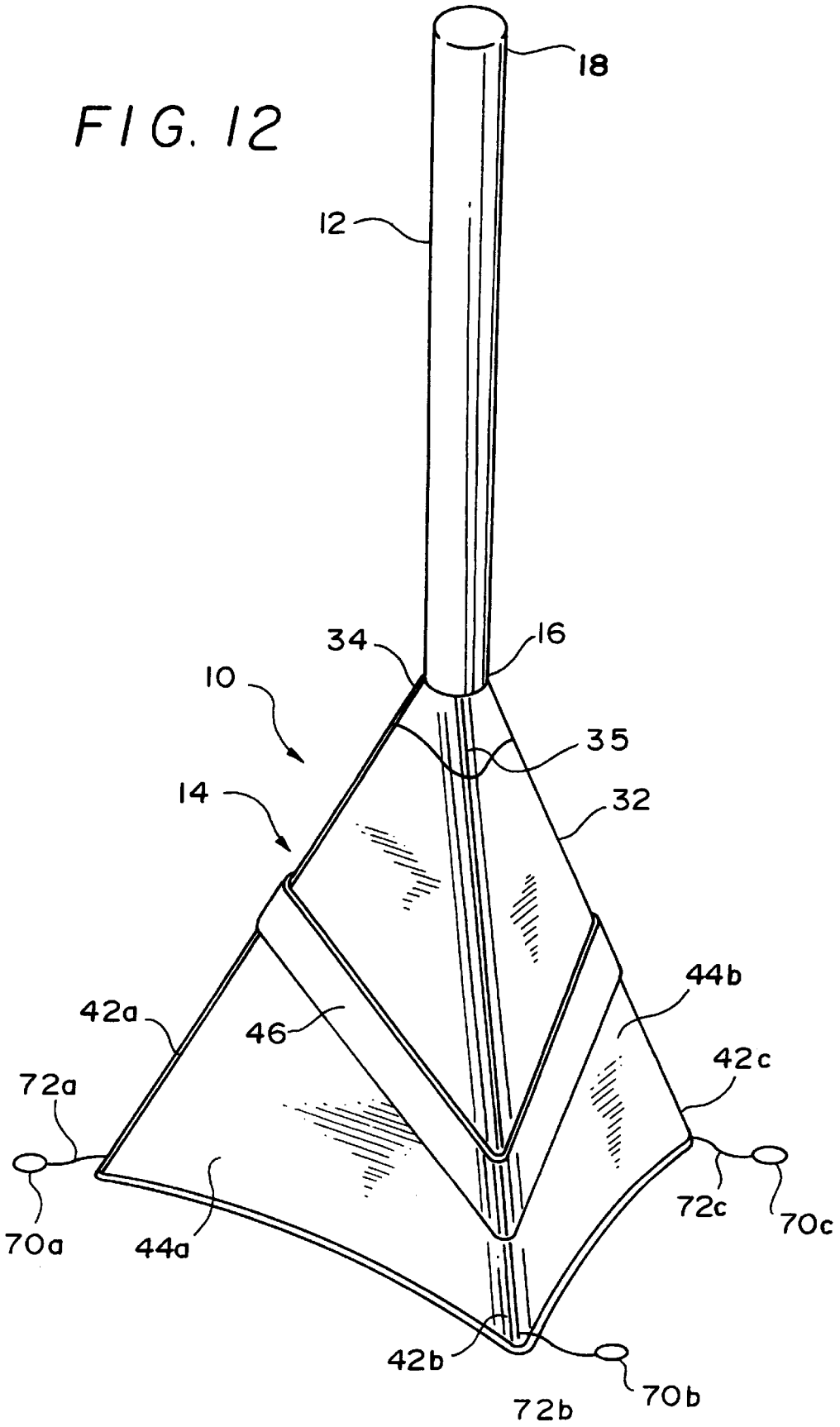
FIG. 12 is a perspective view of an alternate embodiment of the modular cone in accordance with the present invention.

The modular cone 10 may further be provided with stakes 66*a–c* secured adjacent the lower end 36*a–c* of each stay 26*a–c*. The stakes 66*a–c* are used to securely attach the modular cone 10 to the ground. The stakes 66*a–c* are secured to respective stays 26*a–c* by a flexible cord 68*a–c* which allows for wind movement. The stakes 66*a–c* are positioned for storage by placing them parallel to the tube 12 and attaching a circular flexible cord 70 to secure them to the tubular member 12. In the alternative, and with reference to FIG. 12, the modular cone 10 may be securely retained in position by small pouches of sand 70*a–c* having hook and loops closures which are attached to the lower end 36*a–c* of each stay 26*a–c* via elastic cords 72*a–c* which are snap connected at the lower end 36*a–c* of the each stay 26*a–c*.

In use, and as shown in FIG. 10, multiple modular cones 10 may be positioned about a predetermined area to create a barrier thereabout.

The present modular cone is compact and requires little storage space. In fact, it is stored within its own self-contained tube. Yet, when the modular cone is placed into use it expands to provide a rather large cone.

The modular cone may be modified with magnets or suction cups at the ends of the stays to permit mounting of the modular cone on metal, for example, on the hoods or roofs of vehicles or other surfaces. Similarly, the cone may be mounted to horizontally for use a directional signal. The modular cone may also be fitted with emergency locator devices, for example, with a radio frequency emitters such as those used in downed aircrafts or satellite GPS type units.

While preferred materials are disclosed above, a variety of materials may be employed without departing from the spirit of the present invention. It should be further be understood that while the invention has been described and illustrated with respect to the use of cylindrical stays, flat, square, hexagonal or various other shaped stays may be employed, without departing from the scope and content of the present invention. Additionally, while the invention has been described with reference to the use of three stays, two or a number greater than three stays may be employed without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A modular cone, comprising:

a tubular member having an open first end shaped and dimensioned for receipt of a selectively collapsible base member;

the selectively collapsible base member being coupled to the tubular member for selective movement between a stored position in which the base member is stored within the tubular member and a use position in which the base member is retrieved from within the tubular member, the base member including at least three stays resiliently biased outwardly to form a pyramid shape, a fabric cover on the three stays for limiting outward movement of the at least three stays;

the first end of the tubular member including a retaining member shaped and dimensioned to engage a ring member secured at a top of the base member such that the interaction between the retaining member and the ring member prevents the complete withdrawal of the base member from the tubular member while permitting movement of the base member between its said stored position and its said use position.

2. The modular cone according to claim 1, further including a barrier tape.

3. The modular cone according to claim 1, further including a strobe light.

4. The modular cone according to claim 1, further including a sound port.

5. The modular cone according to claim 1, further including a transmitter.

6. The modular cone according claim 1, wherein the three stays are covered with said fabric cover.

7. The modular cone according to claim 1, wherein the base member includes a reflective member.

8. A portable barrier, comprising:

a plurality of modular cones, wherein each modular cone comprises:

a tubular member having an open first end shaped and dimensioned for receipt of a selectively collapsible base member;

the selectively collapsible base member being coupled to the tubular member for selective movement between a stored position in which the base member is stored within the tubular member and a use position in which the base member is retrieved from within the tubular member, the base member including at least three stays resiliently biased outwardly to form a pyramid shape, wherein the base member is shaped and dimensioned to be selectively collapsed and stored within the tubular member, a fabric cover on the three stays for limiting outward movement of the at least three stays;

the first end of the tubular member including a retaining member shaped and dimensioned to engage a ring member secured at a top of the base member such that the interaction between the retaining member and the ring member prevents the complete withdrawal of the base member from the tubular member while permitting movement of the base member between its said stored position and its said use position; and a barrier member associated with each tubular member for selectively coupling the plurality of modular cones to create an effective barrier.

9. The portable barrier according to claim 8, wherein the three stays are covered with said fabric cover.

10. The portable barrier according to claim 8, wherein the base member includes a reflective member.

11. The portable barrier according to claim 8, wherein the barrier member is a barrier tape stored within the tubular member.

12. The portable barrier according to claim 11, wherein the barrier tape includes a free end including means for attachment to an adjacent modular cone.

13. The portable barrier according to claim 12, wherein the means for attachment is a hook member.

14. The portable barrier according to claim 13, wherein the modular cone includes a recess for receiving the hook member.

* * * * *